US006122797A

United States Patent [19]

Vanderlinden

[11] Patent Number: 6,122,797

[45] Date of Patent: Sep. 26, 2000

[54] DEBRIS SUCTIONING AND SEPARATING APPARATUS FOR USE IN A SURFACE CLEANING VEHICLE HAVING A RECIRCULATING TYPE DEBRIS SUCTIONING SYSTEM

[76] Inventor: Roger P. Vanderlinden, 73 Sherman Ave. S., Hamilton, Canada

[21] Appl. No.: 09/253,092

[22] Filed: Feb. 22, 1999

[51] Int. Cl.[7] ..... A47L 5/14

[52] U.S. Cl. ..... 15/346; 15/340.1

[58] Field of Search ..... 15/340.1, 340.3, 15/340.4, 346, 348, 349

[56] References Cited

U.S. PATENT DOCUMENTS

| | | | |
|---|---|---|---|
| 1,033,164 | 7/1912 | Fahrney | 15/346 |
| 1,071,301 | 8/1913 | Diserens | 15/348 |
| 3,512,206 | 5/1970 | Young | 15/346 |
| 3,870,489 | 3/1975 | Shaddock | 15/340.1 |
| 4,578,840 | 4/1986 | Pausch | 15/340.1 |
| 4,885,817 | 12/1989 | Tanase | 15/346 |

*Primary Examiner*—Robert J. Warden, Sr.
*Assistant Examiner*—Theresa T. Snider

[57] ABSTRACT

A debris suctioning and separating apparatus for use in a surface cleaning vehicle has a recirculating type debris suctioning system, including a debris suction head, a debris receiving and retaining hopper, and a main fan. A debris separator's mounted on the surface cleaning vehicle and having an air inlet for receiving debris-laden air into the debris separator, an air outlet for exhausting separated air from the debris separator, and a debris release outlet for selectively releasing separated debris from the debris separator. The air inlet of the debris separator is connected in fluid communication with the debris receiving and retaining hopper and the air outlet of the debris separator is connected in fluid communication with the main fan, to thereby draw debris-laden air, through the hopper, through the air inlet, and into the debris separator, and to exhaust separated air from the debris separator to the main fan. A valve is operatively mounted on the debris separator at the debris release outlet, to effect the controlled flow-restricted release from the debris separator of the separated and captured debris into a debris receptacle, and to preclude the ingress of air and debris into the debris separator through the debris release outlet. Debris is separated from the debris-laden air drawn through the air inlet and into the debris separator, during the operation of the recirculating type debris suctioning system.

6 Claims, 1 Drawing Sheet

DEBRIS SUCTIONING AND SEPARATING APPARATUS FOR USE IN A SURFACE CLEANING VEHICLE HAVING A RECIRCULATING TYPE DEBRIS SUCTIONING SYSTEM

FIELD OF THE INVENTION

The present invention relates to surface cleaning vehicles such as street sweepers and factory sweepers, and more particularly to such surface cleaning vehicles that employ both vacuum and recirculating type suctioning mechanisms.

BACKGROUND OF THE INVENTION

The removal of dirt and debris from streets, parking lots, airport runways, factory floors, and other similar paved surfaces, through the use of various types of street cleaning vehicles, has been known for many years. Such vehicles employ either vacuum or recirculating type suctioning systems, to remove dirt and debris from a surface, lift it several feet up, and deposit it into a hopper. For the sake of brevity, clarity and simplicity, such vehicles will be generally referred to in this document as surface cleaning vehicles.

Typically, surface cleaning vehicles employing either vacuum and recirculating type systems, are used when dust control is a concern or to be able to vacuum up litter and other debris.

Conventional vacuum type systems typically employ a pair of opposed gutter brooms disposed one broom toward each of the left and right sides of the vehicle in spaced apart relation across the width of the vehicle. The gutter brooms rotate about a vertical axis to sweep dirt and debris inward to a central corridor for pickup. A vertically disposed vacuum hose having an open bottom end terminating about one foot above the surface being cleaned vacuums up the debris swept to the central corridor. Wider units have an angled window sweeping broom that feeds dirt over to the vacuum hose. The top end of the vacuum hose is in fluid communication with the hopper that receives the debris therein. The air flow in the vacuum hose is generated by a blower fan mounted on the opposite side of the hopper and exhausted to the ambient surroundings. It is well known, however, that vacuum type systems rely on the slower movement of air in the hopper to separate the debris from the air stream, and do not provide subsequent separation.

Conventional recirculating air type systems typically have a full width one-piece suction head, about five to seven feet in width, and having a flexible peripheral skirt, is driven over the surface to be cleaned, with the skirt in constant contact with the surface. A blower fan draws air from the outlet of the suction head through a large diameter vacuum hose. The dirt and debris suction up through the vacuum hose is deposited into a hopper.

In recirculating type systems, the centrifugally cleaned air is fed back into the one-piece suction head through a supply hose that is attached to an inlet disposed at an inlet end of the one-piece suction head. Turning vanes, typically comprising a set of curved plates, redirect the air blown into the inlet of the one-piece suction head through a forward pointing slot and across the width of the one-piece suction head substantially towards the other side of the suction head and slightly downwardly so as to help gather and capture dirt and debris on the surface being cleaned. The dirt and debris-laden air reaching the other end of the one-piece suction head is again drawn up through the large diameter vacuum hose.

Some conventional regenerative air type street cleaning vehicles employ a dust and debris separator with an integral skimmer hood type sealed collection chamber. The debris separator is essentially a horizontally disposed cylinder having a drop floor section at its bottom along its length, with the drop floor section defining a passage that is in fluid communication with the skimmer hood type sealed collection chamber. The air is passed through the separator in a spiral path. The drop floor section serves to strip the dust and debris from the stream of air. The stripped dust and debris pass under a pliable rubber flap and into the skimmer hood type sealed collection chamber. The separated air is drawn from the separator by the main fan, and is blown back into a suction head, where it impacts the surface being cleaned, before being drawn back up to the hopper and separator.

Recirculating air type street cleaning vehicles tend to experience cessation of the debris separating function when the sealed collection chamber becomes substantially full. In that situation, additional dust and debris cannot enter the collection chamber and thus freely swirl around in the debris separator. Accordingly, air drawn from the separator by the main fan, contains substantial amounts of dust and debris, as opposed to substantially clean air. The dust and debris in the air stream generated by the main fan impact parts of the main fan, thus potentially causing damage and significantly shortening the life of the main fan. Further, the dust and debris-laden air enters the suction head, which causes wear and damage to the suction head, and also to the various air hoses within the system, especially where the air turns corners.

It is an object of the present invention to provide a surface cleaning vehicle of the vacuum air or recirculating air type, having a separator that does not fill up during normal operation and thereby does not lose its ability to separate dust and debris on an ongoing basis, during normal operation of the surface cleaning vehicle.

It is another object of the present invention to provide a surface cleaning vehicle of the vacuum air or recirculating air type, having a separator that precludes the damage and wearing of the main fan and other components that are downstream from the dust and debris separator.

SUMMARY OF THE INVENTION

In accordance with one aspect of the present invention, there is provided a novel debris suctioning and separating apparatus for use in a surface cleaning vehicle. The debris suctioning and separating apparatus comprises a recirculating type debris suctioning system, including a debris suction head, a debris receiving and retaining hopper in fluid communication with the debris suction head to receive debris-laden air therefrom, and a main fan in fluid communication with the debris suction head to provide a stream of air thereto. A debris separator means mounted on the surface cleaning vehicle exteriorly to the hopper and having an air inlet for receiving debris-laden air into the debris separator means, an air outlet for exhausting separated air from the debris separator means, and a debris release outlet for selectively releasing separated debris from the debris separator means. The air inlet of the debris separator means is connected in fluid communication with the debris receiving and retaining hopper and the air outlet of the debris separator means is connected in fluid communication with the main fan, to thereby draw debris-laden air, through the hopper, through the air inlet, and into the debris separator means, and to exhaust separated air from the debris separator means to the main fan. A valve means is operatively mounted on the debris separator means at the debris release outlet, to effect the controlled flow-restricted release from the debris separator means of the separated and captured debris into a debris receptacle, and to preclude the ingress of air and debris into the debris separator means through the debris release outlet. Debris is separated from the debris-laden air drawn through the air inlet and into the debris separator means, during the operation of the surface cleaning means.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described hereinbelow.

BRIEF DESCRIPTION OF THE DRAWINGS

The novel features which are believed to be characteristic of the dust retaining apparatus according to the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only, and are not intended as a definition of the limits of the invention. In the accompanying drawing.

DETAILED DESCRIPTION OF A PREFERRED EMBODIMENT

Figure 1:
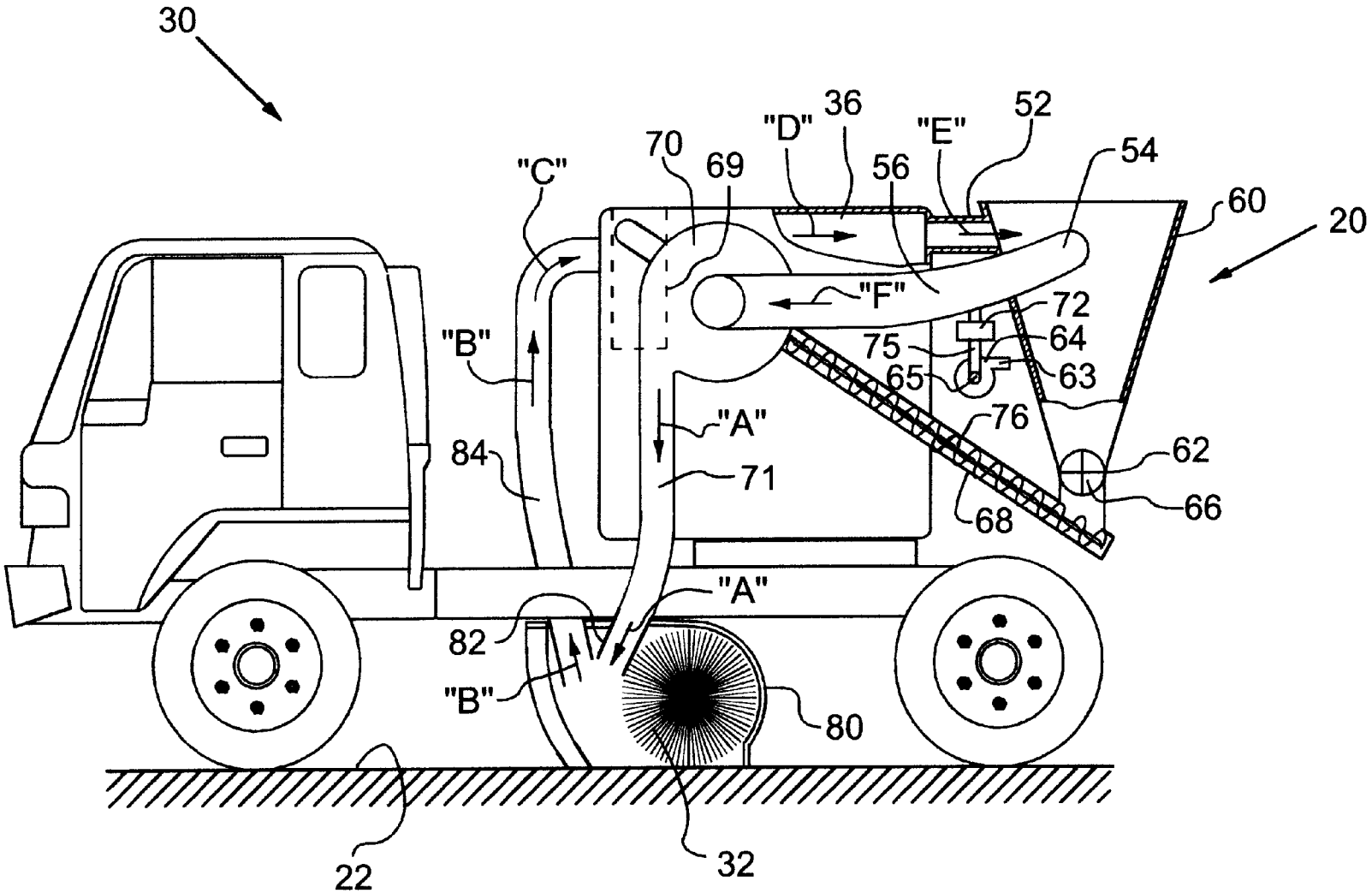
FIG. 1 is a side elevational view of a preferred embodiment of the debris suctioning and separating apparatus according to the present invention, installed on a recirculating air type surface cleaning vehicle, with a portion of the side of the surface cleaning vehicle removed for the sake of clarity.

Reference will now be made to FIG. 1, which shows a preferred embodiment of the debris suctioning and separating apparatus of the present invention, as indicated by general reference numeral 20, for use in a surface cleaning vehicle, as indicated by general reference numeral 30. The type surface cleaning vehicle 30 is a recirculating air type surface cleaning vehicle, having a recirculating type debris suctioning system, including a debris suction head 80, a debris receiving and retaining hopper 36 in fluid communication with the debris suction head 80 to receive debris-laden air therefrom, and a main fan 70 in fluid communication with the debris suction head 80 to provide a stream of air thereto.

An optional integral sweeping broom 32 is mounted within the suction head 80. A forceful flow of air is blown by the large capacity main fan 70 through a large diameter air supply hose 71, as indicated by arrows "A", to exit at a nozzle 82 in the suction head 80, whereat the expelled air impinges on the surface being cleaned 22. A suction hose 84 draws debris-laden air upwardly, as indicated by arrows "B", and into the debris receiving and retaining hopper 36, as indicated by arrow "C", whereat a substantial portion of the debris in the air stream falls into the debris receiving and retaining hopper 36.

A debris separator means comprising a cyclonic separator 60 is mounted on the surface cleaning vehicle 30 exteriorly to and immediately behind the debris receiving and retaining hopper 36. The cyclonic separator 60 has an air inlet 52 connected in fluid communication with the debris receiving and retaining hopper 36 for receiving debris-laden air into the cyclonic separator 60. The cyclonic separator 60 also has an air outlet 54 connected in fluid communication with the main fan 70 via a large diameter hose 56.

Debris-laden air is drawn by the main fan 70 through the hopper 36 and into the air inlet 52, as indicated by arrow "D", and then into the cyclonic separator 60, as indicated by arrow "E". The cyclonic separator 60 then separates the debris from the debris-laden air, thereby substantially precluding the escape of debris into the atmosphere. The separated air is then exhausted from the cyclonic separator 60 to the main fan 70, as indicated by arrow "F", which main fan 70 forcefully blows air into the suction head 80 through the supply hose 71, as discussed above.

An auxiliary fan 64 has an inlet 65 connected in fluid communication to the large diameter hose 56 via an auxiliary pipe 75 and has an outlet. The purpose of the auxiliary fan 64 is to reduce the ambient air pressure within the suction head 80, thus helping to preclude debris from escaping. A self-purging secondary air filter 72 is disposed in the auxiliary pipe 75 to capture the small amount of debris that might pass through the cyclonic separator 60.

The cyclonic separator 60 also has a debris release outlet 62 for selectively releasing separated debris from the cyclonic separator 60. A valve means comprising a positive sealing rotary valve 66 is operatively mounted on the cyclonic separator 60 at the debris release outlet 62, to effect the controlled flow-restricted release from the cyclonic separator 60 of the separated and captured debris into a debris receptacle 69 disposed within the hopper 36, which debris receptacle 69 is in substantially sealed relation with respect to the rest of the hopper 36. The positive sealing rotary valve 66 precludes the ingress of air and debris into the cyclonic separator 60 through the debris release outlet 62. The captured debris is deposited into the debris receptacle 69 via an auger 76 in a sloped chute 68.

Other variations of the above principles will be apparent to those who are knowledgeable in the field of the invention, and such variations are considered to be within the scope of the present invention. Further, other modifications and alterations may be used in the design and manufacture of the apparatus of the present invention without departing from the spirit and scope of the accompanying claims.

What is claimed is:

1. A debris suctioning and separating apparatus for use in a surface cleaning vehicle, said debris suctioning and separating apparatus comprising:

a regenerative type debris auctioning system, including a debris suction head, a debris receiving and retaining hopper in fluid communication with said debris suction head to receive debris-laden air therefrom, and a main fan in fluid communication with said debris suction head to provide a stream of air thereto;

debris separator means mounted on said surface cleaning vehicle exteriorly to said hopper and having an air inlet for receiving debris-laden air into said debris separator means, an air outlet for exhausting separated air from said debris separator means, and a debris release outlet for selectively releasing separated debris from said debris separator means;

wherein said air inlet of said debris separator means is connected in fluid communication with said debris receiving and retaining hopper and said air outlet of said debris separator means is connected in fluid communication with said main fan, to thereby draw debris-laden air, through said hopper, through said air inlet, and into said debris separator means, and to exhaust separated air from said debris separator means to said main fan;

valve means operatively mounted on the debris separator means at said debris release outlet, to effect the controlled flow-restricted release from said debris separator means of the separated and captured debris into a debris receptacle, and to preclude the ingress of air and debris into said debris separator means through said debris release outlet;

wherein debris is separated from said debris-laden air drawn through said air inlet and into said debris separator means, during the operation of the regenerative type debris suctioning system.

2. The debris suctioning and separating apparatus of claim 1, wherein said debris separator means comprises a cyclonic separator.

3. The debris suctioning and separating apparatus of claim 1, wherein said debris receptacle is disposed within said hopper.

4. The debris suctioning and separating apparatus of claim 3, wherein said debris receptacle is in substantially sealed relation with respect to the rest of said hopper.

5. The debris suctioning and separating apparatus of claim 1, wherein said valve means comprises a positive sealing valve.

6. The debris suctioning and separating apparatus of claim 5, wherein said positive sealing valve comprises a positive sealing rotary valve.

* * * * *